US010825334B2

(12) United States Patent
Pedersen et al.

(10) Patent No.: US 10,825,334 B2
(45) Date of Patent: Nov. 3, 2020

(54) SMOKE DETECTOR OPERATIONAL INTEGRITY VERIFICATION SYSTEM AND METHOD

(71) Applicant: Autronica Fire & Security AS, Trondheim (NO)

(72) Inventors: Ole Martin Pedersen, Trondheim (NO); Fredleif Buaas-Hansen, Stjørdal (NO); Per Johan Vannebo, Trondheim (NO)

(73) Assignee: AUTRONICA FIRE & SECURITY AS, Trondheim (NO)

( * ) Notice: Subject to any disclaimer, the term of this patent is extended or adjusted under 35 U.S.C. 154(b) by 0 days.

(21) Appl. No.: 16/317,730

(22) PCT Filed: Jul. 19, 2017

(86) PCT No.: PCT/EP2017/068192
§ 371 (c)(1),
(2) Date: Jan. 14, 2019

(87) PCT Pub. No.: WO2018/015418
PCT Pub. Date: Jan. 25, 2018

(65) Prior Publication Data

US 2019/0164414 A1 May 30, 2019

Related U.S. Application Data

(60) Provisional application No. 62/364,066, filed on Jul. 19, 2016.

(51) Int. Cl.
*G08B 17/107* (2006.01)
*G08B 29/14* (2006.01)
(Continued)

(52) U.S. Cl.
CPC ..... *G08B 29/043* (2013.01); *G08B 17/107* (2013.01)

(58) Field of Classification Search
CPC ..... G08B 29/043
See application file for complete search history.

(56) References Cited

U.S. PATENT DOCUMENTS 4,306,230 A 12/1981 Forss et al.
4,647,785 A 3/1987 Morita
(Continued)

FOREIGN PATENT DOCUMENTS

CN 203250384 U 10/2013
DE 102009054141 A1 5/2011
(Continued)

OTHER PUBLICATIONS

International Search Report and Written Opinion regarding related PCT App. No. PCT/EP2017/068192; dated Nov. 20, 2017; 15 pgs.

*Primary Examiner* — Joseph H Feild
*Assistant Examiner* — Pameshanand Mahase
(74) *Attorney, Agent, or Firm* — Cantor Colburn LLP

(57) ABSTRACT

A smoke detector operational integrity verification system includes a plurality of electronic components. Also included is a controller in operative communication with the plurality of electronic components. Further included is an evaluation module of the controller receiving an output signal of the plurality of electronic components as an output voltage over a period of time, the output voltage measured at a plurality of times compared to predefined acceptable ranges.

12 Claims, 3 Drawing Sheets

(51) Int. Cl.

| | |
|---|---|
| ***G08B 17/06*** | (2006.01) |
| ***G08B 29/12*** | (2006.01) |
| ***G08B 25/14*** | (2006.01) |
| ***G08B 29/04*** | (2006.01) |

(56) References Cited

U.S. PATENT DOCUMENTS

| | | | | |
|---|---|---|---|---|
| 5,247,283 | A | 9/1993 | Kobayashi et al. | |
| 5,450,059 | A | 9/1995 | Arroubi et al. | |
| 5,523,743 | A | 6/1996 | Rattman et al. | |
| 5,552,765 | A | 9/1996 | Vane et al. | |
| 5,699,043 | A | 12/1997 | Vane et al. | |
| 5,764,142 | A | 6/1998 | Anderson et al. | |
| 5,798,701 | A | 8/1998 | Bernal et al. | |
| 5,821,866 | A * | 10/1998 | Bernal | G08B 17/107 340/630 |
| 6,225,910 | B1 * | 5/2001 | Kadwell | G08B 17/107 250/573 |
| 6,396,405 | B1 | 5/2002 | Bernal et al. | |
| 6,756,906 | B2 | 6/2004 | Bernal et al. | |
| 6,838,988 | B2 | 1/2005 | Lennartz et al. | |
| 7,133,125 | B2 | 11/2006 | French et al. | |
| 7,224,284 | B2 | 5/2007 | Mi et al. | |
| 7,242,288 | B2 | 7/2007 | Kaiser et al. | |
| 7,623,981 | B2 | 11/2009 | Achkar et al. | |
| 8,228,182 | B2 | 7/2012 | Orsini et al. | |
| 8,587,442 | B2 | 11/2013 | Loepfe et al. | |
| 8,760,651 | B2 | 6/2014 | Kato et al. | |
| 8,890,704 | B2 | 11/2014 | Barrieau et al. | |
| 9,117,359 | B2 | 8/2015 | Hanses et al. | |
| 9,171,453 | B2 | 10/2015 | Warmack et al. | |
| 9,506,942 | B2 | 11/2016 | Makino et al. | |
| 9,659,485 | B2 | 5/2017 | Piccolo | |
| 9,679,468 | B2 | 6/2017 | Piccolo, III et al. | |
| 9,831,829 | B2 | 11/2017 | Irwin et al. | |
| 9,959,748 | B2 | 5/2018 | Moffa | |
| 2001/0038338 | A1 * | 11/2001 | Kadwell | G08B 17/107 340/630 |
| 2001/0048319 | A1 * | 12/2001 | Miyazaki | H03K 19/00384 326/1 |
| 2004/0056765 | A1 | 3/2004 | Anderson et al. | |
| 2009/0128821 | A1 * | 5/2009 | Sugimoto | G01N 21/274 356/438 |
| 2011/0037971 | A1 | 2/2011 | Loepfe et al. | |
| 2014/0009297 | A1 | 1/2014 | Barrieau et al. | |
| 2015/0145684 | A1 | 5/2015 | Schmid | |
| 2015/0302727 | A1 | 10/2015 | Piccolo, III | |
| 2015/0310732 | A1 | 10/2015 | Piccolo, III | |
| 2015/0346086 | A1 | 12/2015 | Erdtmann | |
| 2015/0371514 | A1 | 12/2015 | Bonisch et al. | |

FOREIGN PATENT DOCUMENTS

| | | | |
|---|---|---|---|
| EP | 0055319 | A1 | 7/1982 |
| EP | 0971329 | A1 | 1/2000 |
| EP | 1350235 | B1 | 12/2004 |
| EP | 1798699 | A1 | 6/2007 |
| WO | 2012041580 | A1 | 4/2012 |
| WO | 2018015418 | A1 | 1/2018 |

* cited by examiner

SMOKE DETECTOR OPERATIONAL INTEGRITY VERIFICATION SYSTEM AND METHOD

CROSS-REFERENCE TO RELATED APPLICATIONS

This application is based on International Application No. PCT/EP2017/068192 filed on Jul. 19, 2017, which claims priority to U.S. Provisional Patent Application Ser. No. 62/364,066, filed on Jul. 19, 2016, both of which are incorporated herein by reference in their entireties.

BACKGROUND OF THE DISCLOSURE

The embodiments described herein generally relate to smoke detectors and, more particularly, to systems and methods for verifying operational integrity of smoke detectors.

The ability to detect the presence of fire and/or smoke provides for the safety of occupants and property. In particular, because of the rapid expansion rate of a fire, it is important to detect the presence of a fire as early as possible. Smoke detectors are employed to assist with early detection. In safety critical equipment it is important to detect, and warn, that the equipment is not able to fulfil its function if such a condition arises. Such a condition must be detected as soon as possible.

Optical smoke detectors include various components that are challenging to monitor and detect malfunctions associated therewith. It is difficult to verify the optical function of the smoke detector, as well as amplifier(s) and filters, while still maintaining a low cost and complexity for such components and monitoring systems. For example, while adding additional hardware to be used to perform such monitoring may be effective, the cost of such additions is undesirable.

BRIEF DESCRIPTION OF THE DISCLOSURE

According to one embodiment, a detector operational integrity verification system includes a plurality of electronic components. Also included is a controller in operative communication with the plurality of electronic components. Further included is an evaluation module of the controller receiving an output signal of the plurality of electronic components as an output voltage over a period of time, the output voltage measured at a plurality of times compared to predefined acceptable ranges.

In addition to one or more of the features described above, or as an alternative, further embodiments may include that the plurality of electronic components comprises at least one signal converter, and at least one amplifier with at least one filter.

In addition to one or more of the features described above, or as an alternative, further embodiments may include that the smoke detector is an optical smoke detector comprising a plurality of optical components.

In addition to one or more of the features described above, or as an alternative, further embodiments may include that the plurality of optical components comprises a light emitting element and a light receiving element.

In addition to one or more of the features described above, or as an alternative, further embodiments may include that the output voltage of the amplifier is measured as a nominal voltage ($V_A$) when the light emitting element is in an inactive condition, as a maximum voltage ($V_B$) when the light emitting element is switched to an active condition, and as a minimum voltage ($V_C$) immediately after the light emitting element is switched back to the inactive condition.

In addition to one or more of the features described above, or as an alternative, further embodiments may include that the output voltage of the amplifier is measured as a nominal voltage ($V_A$) when the light emitting element is in an inactive condition, as a minimum voltage ($V_C$) when the light emitting element is switched to an active condition, and as a maximum voltage ($V_B$) immediately after the light emitting element is switched back to the inactive condition.

In addition to one or more of the features described above, or as an alternative, further embodiments may include that the evaluation module compares the nominal voltage ($V_A$) to a predefined acceptable range of nominal voltages.

In addition to one or more of the features described above, or as an alternative, further embodiments may include that the evaluation module compares a difference between the maximum voltage ($V_B$) and the minimum voltage ($V_C$) to a predefined acceptable range of differences.

In addition to one or more of the features described above, or as an alternative, further embodiments may include that the evaluation module calculates a ratio ((VB−VA)/(VA−VC)) that is compared to a predefined acceptable range of ratios.

According to another embodiment, a method of verifying smoke detector operational integrity is provided. The method includes measuring a nominal output signal as a nominal voltage ($V_A$), the nominal output signal generated by a plurality of optical and electronic components when a light emitting element is in an inactive condition. Also included is switching the light emitting element to an active condition. Further included is measuring a maximum output signal as a maximum voltage ($V_B$). Yet further included is switching the light emitting element to the inactive condition. Also included is measuring a minimum output signal as a minimum voltage ($V_C$). Further included is inputting at least one of the measured voltages into an algorithm stored on a controller. Yet further included is comparing an algorithm output with a range of predetermined acceptable values to verify operational integrity of the smoke detector, the comparison done by an evaluation module of a smoke detector controller.

In addition to one or more of the features described above, or as an alternative, further embodiments may include determining if the nominal voltage ($V_A$) is within a predefined acceptable range of nominal voltages with the evaluation module.

In addition to one or more of the features described above, or as an alternative, further embodiments may include determining if a difference between the maximum voltage ($V_B$) and the minimum voltage ($V_C$) is within a predefined acceptable range of differences with the evaluation module over time.

In addition to one or more of the features described above, or as an alternative, further embodiments may include determining if a ratio (VB−VA)/(VA−VC) is within a predefined acceptable range of ratios with the evaluation module.

In addition to one or more of the features described above, or as an alternative, further embodiments may include determining if the ratio (VB−VA)/(VA−VC)) remains constant over a specified time period with the evaluation module.

In addition to one or more of the features described above, or as an alternative, further embodiments may include determining if the position in time of the extreme values comprising the minimum voltage ($V_B$) and maximum voltage ($V_C$) relative to the emitted light pulse are within predefined limits.

These and other advantages and features will become more apparent from the following description taken in conjunction with the drawings.

BRIEF DESCRIPTION OF THE DRAWINGS

The subject matter which is regarded as the disclosure is particularly pointed out and distinctly claimed in the claims at the conclusion of the specification. The foregoing and other features and advantages of the disclosure are apparent from the following detailed description taken in conjunction with the accompanying drawings in which:

DETAILED DESCRIPTION OF THE DISCLOSURE

Figure 1:
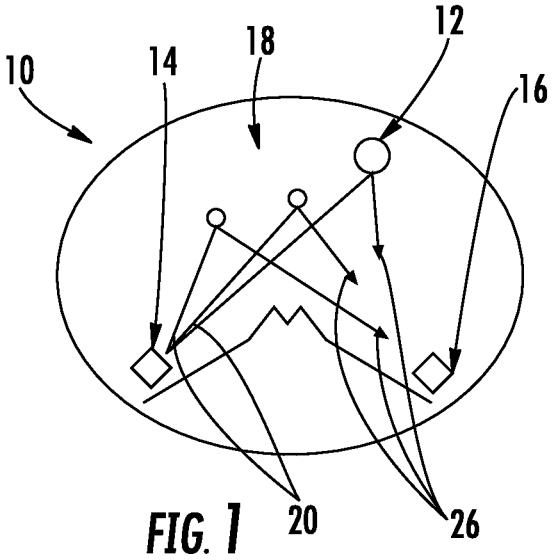
FIG. 1 is a schematic illustration of an optical smoke detector in a first condition.
Figure 2:
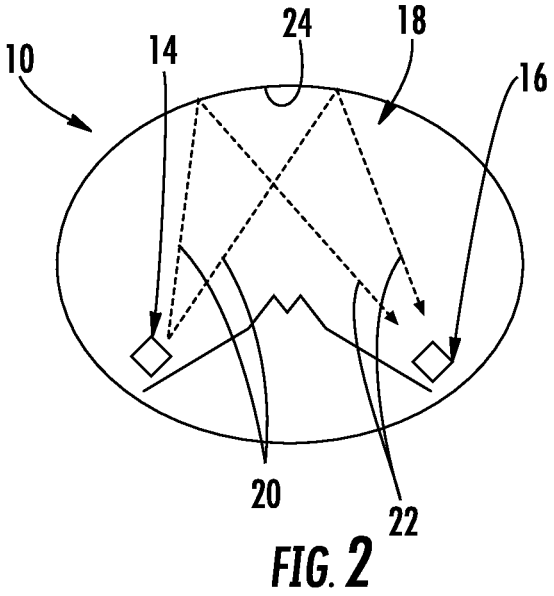
FIG. 2 is a schematic illustration of the optical smoke detector in a second condition.

Referring to FIGS. 1 and 2, a detector is illustrated and generally referenced with numeral 10. The detector is a smoke detector 10 in some embodiments and is referred to as such herein, but it is to be appreciated that other detectors may benefit from the embodiments described herein. The smoke detector 10 is operable to sense the presence of smoke particles 12 and to generate or to initiate an alarm signal. The smoke detector 10 may be realized as a stand-alone system or may be part of a fire monitoring system comprising a plurality of such smoke detectors and/or other types of smoke detectors.

The smoke detector 10 comprises a light emitting element 14, such as a light emitting diode (LED) in some embodiments, and a light receiving element 16, such as a photodiode in some embodiments. The light emitting element 14 and the light receiving element 16 are disposed within a detection area 18 of the smoke detector 10 that is fluidly coupled to the environment so that the smoke particles 12 are able to enter the detection area 18, but the detection area 18 is enclosed in such a way that no disturbing light from the environment can reach the light receiving element 16.

Figure 3:
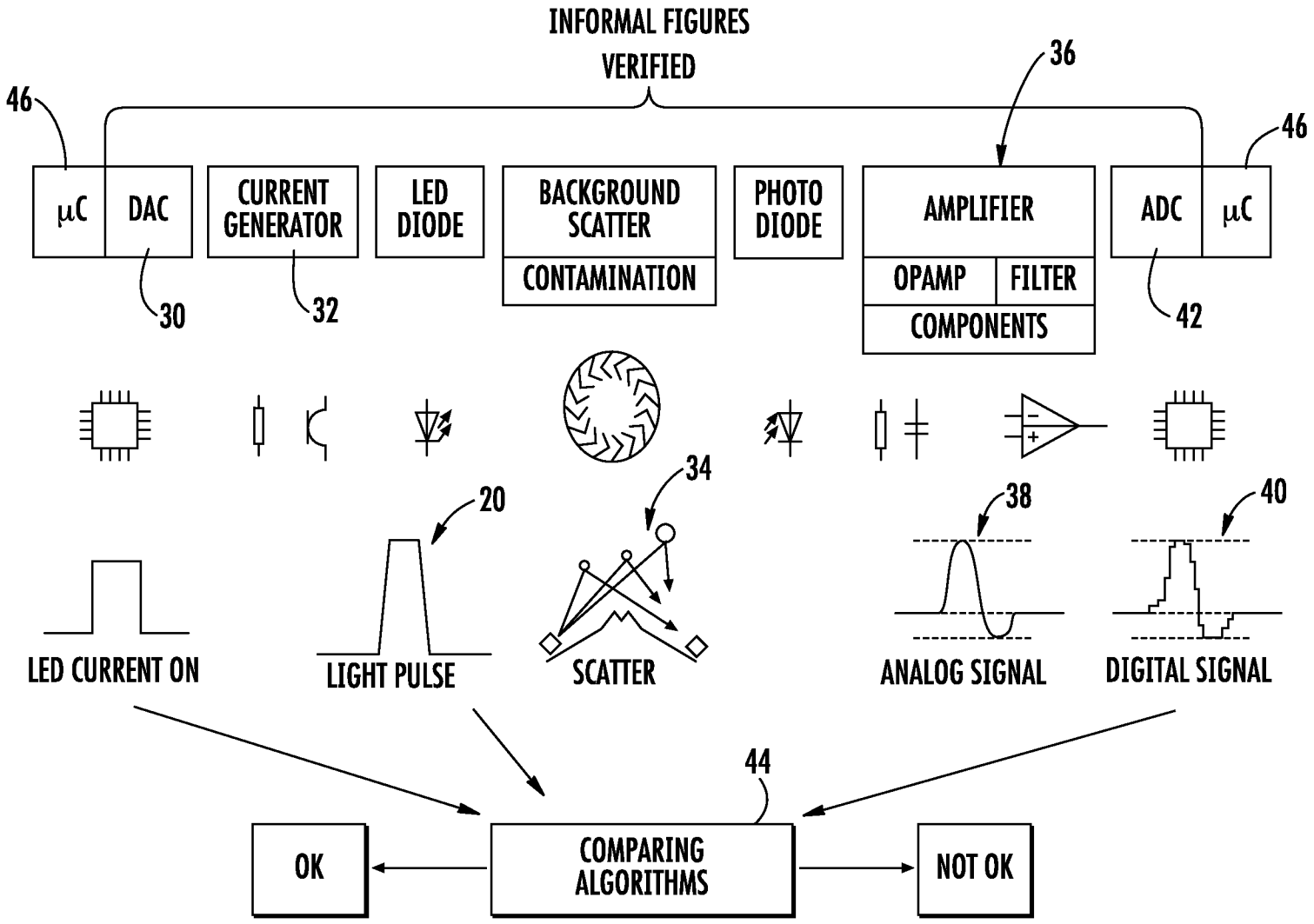
FIG. 3 is a schematic illustration of electrical circuitry of the optical smoke detector.

In operation, the light emitting element 14 emits light pulses 20 with a duration or pulse length (FIG. 3). Due to the orientation of the optical axis of the light emitting element 14 and the light receiving element 16 no direct light can reach the light receiving element 16. Only some light is scattered as noise light 22 from the inner walls 24 of the detection area 18 and reaches the light receiving element 16, as shown in FIG. 2. In case of presence of smoke particles 12, as shown in FIG. 1, the smoke detector 10 is in alarm operation, whereby light is scattered by the smoke particles 12 and reaches the light receiving element 16 as scattered light 26. The amount of light reaching the light receiving element 16 is higher than that present in the condition of FIG. 2.

Referring to FIG. 3, additional operation of the smoke detector 10 is schematically illustrated. As discussed above, a digital-to-analog converter 30 works with a current generator 32 to provide the light pulses 20 generated by the light emitting element 14. The light scattering and detection by the light receiving element 16 is represented generally with numeral 34. The light collected by the light receiving element 16 is electrically converted into a detection signal, which is fed into an amplifier circuit 36 that generates an amplified analog output signal 38. The analog amplified output signal 38 is converted to an output digital signal 40 with an analog-to-digital converter 42 and communicated to an evaluation module 44. In some embodiments, the evaluation module 44 is part of a controller 46. As will be appreciated from the disclosure herein, the evaluation module 44 comprises software that includes comparison algorithms that verifies the optical and electrical integrity of the smoke detector 10 by comparing the electric output of the smoke detector circuitry with a predefined and verified output. This verification is based on software analysis in the controller 46, thereby avoiding the need for the addition of extra hardware and the costs associated therewith.

Figure 4:
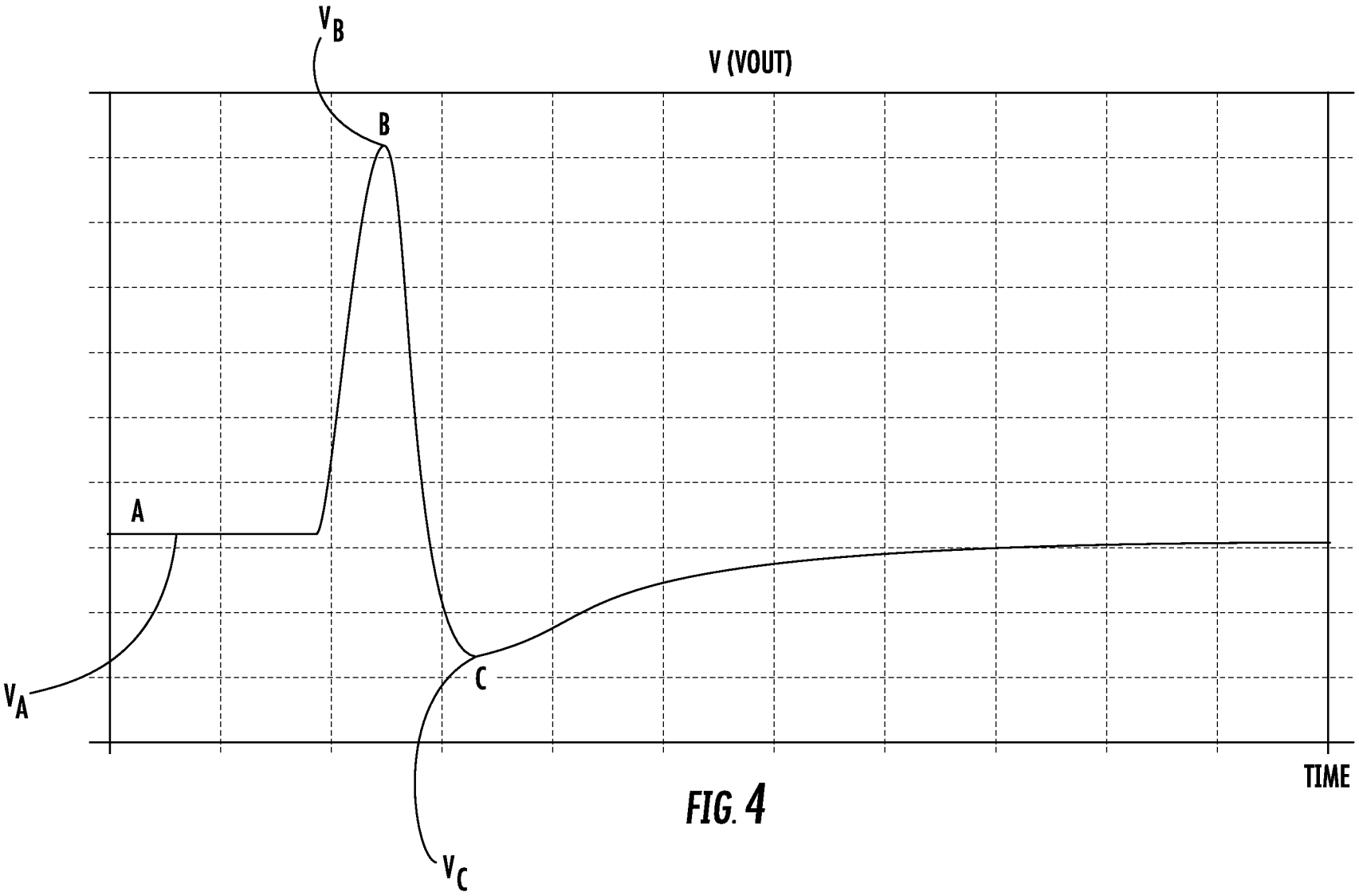
FIG. 4 is a plot of an output signal of the electrical circuitry vs. time.

Referring now to FIG. 4, a time response plot is illustrated with the output digital signal 40 shown as a function of time. As discussed above, the output digital signal 40 is ultimately a function of the light pulse 20. The light pulse 20 is constant and predefined, with the processed output following a well-defined pattern in both smoke and no-smoke conditions. A nominal background signal is represented by A on the plot. The nominal background signal is present when the light emitting element 14 is inactive (e.g., off). When the light emitting element 14 is active (e.g., on), the output digital signal 40 will overshoot to reach a maximum signal value that is represented by B on the plot. When the light emitting element 14 is switched off, the signal value will undershoot below the nominal signal A to a minimum signal value that is represented by C on the plot before it settles up to the nominal background signal A again. Alternatively, the nominal background signal may be present when the light emitting element 14 is active (e.g., on). When the light emitting element 14 is inactive (e.g., off), the output digital signal 40 will adjust to reach the minimum signal value. When the light emitting element 14 is switched off, the signal value will adjust to the maximum signal value before it settles up to the nominal background signal A again. Therefore, it is the extreme values that are of significance, not necessarily the order in which the data is taken.

The evaluation module 44 compares the three measured signals A, B and C with predefined values that are acceptable operational ranges. The predefined values calculated are based on theoretically determined values which are then experimentally refined.

The signal is plotted with voltage values and the nominal voltage $V_A$ should be between allowed values $V_{nom_min}$ and $V_{nom_max}$. This verifies the offset voltage for the amplifier, that there is no ambient light leaking into the chamber, and that the amplifier is functioning properly. The measure is valid both in smoke and no-smoke situations. $V_A$ may drift for multiple possible reasons. For example, natural temperature effects may impact the signal and are acceptable within a limit. Light leakage detrimentally impacts the overall operation of the smoke detector 10 and is not deemed acceptable. Amplifier and/or sensor (i.e., light receiving element) failure is also not deemed acceptable.

The comparison made by the evaluation module focuses on a ratio of differences of the measured signals. In particular, the following ratio is calculated: (VB−VA)/(VA−VC). This ratio is constant within a tolerance. This measure verifies the filter components in the amplifier circuitry. The measure is valid as long as the output is within amplifier saturation limits. This ratio measure is reasonable as the light reflected by smoke particles 12 is linear relative to the amount of smoke entered. The "overshoot" voltage $V_B$ and the "undershoot" voltage $V_C$ is linear to the amount of smoke present, and they are both an effect of the filter characteristics. The measure is valid both in smoke and no-smoke situations. The long-term difference between $V_B$ and $V_C$ ($V_B$–$V_C$) must be within a set range. This guarantees a certain background reflection is present inside the detection chamber of the smoke detector 10. It also tells if the smoke detector 10 is contaminated with dust or other contaminants, if the optical components are functioning properly, or if the gain of the amplifier is reduced.

There are alternative methods of determining the validity of the received pulse. For example, a burst of analog to digital conversions can be made throughout the pulse, with the sum, or sum of squares, of the samples being calculated to determine the magnitude of the received signal. Additionally, the expected pulse can be stored in the memory of the controller. The measured pulse is then multiplied with a factor that is the ratio between the magnitude of the stored and measured pulse. After this multiplication (normalization), the measured waveform, and the difference must be below a predefined limit. In addition to one or more of the features described above, or as an alternative, the cross-correlation between the stored and measured pulse must be above a certain limit.

Advantageously, comparing the ratio of differences provides detection light source/sensor failure, detection of amplifier failure or erroneous components in the amplifier circuitry. All detection and verification is done with software, thereby providing the option of enhanced reliability for inexpensive smoke detectors.

The use of the terms "a" and "an" and "the" and similar referents in the context of the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A detector operational integrity verification system comprising:

a plurality of electronic components;

a controller in operative communication with the plurality of electronic components; and an evaluation module of the controller receiving an output signal of the plurality of electronic components as an output voltage over a period of time, the output voltage measured at a plurality of times compared to predefined acceptable ranges, the output voltage comprising a maximum voltage ($V_B$) and a minimum voltage ($V_C$), the evaluation module verifying operational integrity in response to the maximum voltage ($V_B$) and the minimum voltage ($V_C$);

wherein the plurality of electronic components comprises at least one signal converter, at least one amplifier with at least one filter;

wherein the output voltage of the amplifier is measured as a nominal voltage ($V_A$) when the light emitting element is in an inactive condition, as the maximum voltage ($V_B$) when the light emitting element is switched to an active condition, and as the minimum voltage ($V_C$) immediately after the light emitting element is switched back to the inactive condition.

2. The system of claim 1, wherein the detector is an optical smoke detector comprising a plurality of optical components.

3. The system of claim 2, wherein the plurality of optical components comprises a light emitting element and a light receiving element.

4. The system of claim 1, wherein the evaluation module compares the nominal voltage ($V_A$) to a predefined acceptable range of nominal voltages.

5. The system of claim 1, wherein the evaluation module compares a difference between the maximum voltage ($V_B$) and the minimum voltage ($V_C$) to a predefined acceptable range of differences.

6. The system of claim 1, wherein the evaluation module calculates a ratio ($V_B$–$V_A$)/($V_A$–$V_C$)) that is compared to a predefined acceptable range of ratios.

7. A method of verifying smoke detector operational integrity comprising:

measuring a nominal output signal as a nominal voltage ($V_A$), the nominal output signal generated by a plurality of optical and electronic components when a light emitting element is in an inactive condition;

switching the light emitting element to an active condition;

measuring a maximum output signal as a maximum voltage ($V_B$);

switching the light emitting element to the inactive condition;

measuring a minimum output signal as a minimum voltage ($V_C$);

inputting the maximum voltage ($V_B$) and the minimum voltage ($V_C$) into an algorithm stored on a controller; and comparing an algorithm output with a range of predetermined acceptable values to verify operational integrity of the smoke detector, the comparison done by an evaluation module of a smoke detector controller.

8. The method of claim 7, further comprising determining if the nominal voltage ($V_A$) is within a predefined acceptable range of nominal voltages with the evaluation module.

9. The method of claim 7, further comprising determining if a difference between the maximum voltage ($V_B$) and the minimum voltage ($V_C$) is within a predefined acceptable range of differences with the evaluation module over a period of time.

10. The method of claim 7, further comprising determining if a ratio (($V_B$–$V_A$)/($V_A$–$V_C$)) is within a predefined acceptable range of ratios with the evaluation module.

11. The method of claim 10, further comprising determining if the ratio (($V_B$–$V_A$)/($V_A$–$V_C$)) remains constant over a specified time period with the evaluation module.

12. The method of claim 7, further comprising determining if the position in time of the extreme values if the extreme values comprising the minimum voltage ($V_B$) and maximum voltage ($V_C$) relative to the emitted light pulse are within predefined limits.

* * * * *